United States Patent [19]

Kobayashi et al.

[11] 4,246,000

[45] Jan. 20, 1981

[54] FUEL COMPOSITIONS COMPRISING COAL-LIQUID FUEL MIXTURE

[75] Inventors: Toshiaki Kobayashi, Kyoto; Tomio Nobe, Jyoyo; Hiroshi Niimi, Kamakura; Tetsuo Wada, Oomuta, all of Japan

[73] Assignees: New Japan Chemical Co., Ltd.; Mitsui Coke Co., Ltd.; Mitsui Miike Machinery Co., Ltd.; Toko Kasei Ltd., all of Kyoto, Japan

[21] Appl. No.: 78,811

[22] Filed: Sep. 25, 1979

[51] Int. Cl.[3] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 1,444,723 | 2/1923 | Bates | 44/51 |
| 2,590,733 | 3/1953 | Stillman | 44/51 |

FOREIGN PATENT DOCUMENTS

| | | |
|---|---|---|
| 53-82809 | 7/1978 | Japan . |
| 53-88008 | 8/1978 | Japan . |
| 53-101006 | 9/1978 | Japan . |
| 53-123404 | 10/1978 | Japan . |
| 123406 | 10/1978 | Japan . |

*Primary Examiner*—Winston A. Douglas
*Assistant Examiner*—Y. Harris-Smith
*Attorney, Agent, or Firm*—Larson, Taylor and Hinds

[57] ABSTRACT

The invention provides: a fuel composition comprising 100 parts by weight of a coal-liquid fuel mixture and 0.02 to 1.0 part by weight of at least one additive selected from the group consisting of dibenzylidene sorbitol, ditoluylidene sorbitol, tribenzylidene sorbitol, tritoluylidene sorbitol and hydrogenated castor oil; and a fuel composition comprising 100 parts by weight of a coal-liquid fuel mixture, 0.02 to 1.0 part by weight of at least one additive selected from the group consisting of dibenzylidene sorbitol, ditoluylidene sorbitol, tribenzylidene sorbitol, tritoluylidene sorbitol and hydrogenated castor oil, and 1 to 10 parts by weight of water. The composition shows high stability over a prolonged period of time, preventing the separation into layers of the components.

7 Claims, No Drawings

FUEL COMPOSITIONS COMPRISING COAL-LIQUID FUEL MIXTURE

This invention relates to fuel compositions comprising a coal-liquid fuel mixture.

With concern over steady supplies of petroleum and a sharp rise in its price, coal has attracted renewed attention as a fuel in recent years. Presumably coal will be used predominantly in the form of a liquefied fuel in the future, but the coal liquefying techniques heretofore developed still remain to be improved. Presently coal appears most useful when used in the form of a so-called coal and oil mixture or coal-in-oil suspension (hereinafter referred to briefly as "COM") which is prepared by admixing coal with a liquid fuel such as fuel oil. For example, COM seems usable directly in existing steam power plants. However since coal differs greatly in specific gravity, for example, from fuel oil (about 1.3–1.5 vs. about 0.9), the coal contained in the COM, even if as fine as minus 200 mesh in particle size, settles and cakes within a relatively short period of time. The settlement and caking of coal will cause separation of the COM into layers during storage and transport or plug up the supply line, consequently disturbing the steady operation of the steam power plant. Thus the use of the COM is still infeasible.

Accordingly the main object of this invention is to provide COM compositions in which the coal has reduced susceptibility to settlement and caking.

Other objects and features of the invention will become apparent from the following description.

The present invention provides a fuel composition comprising 100 parts by weight of a coal-liquid fuel mixture and about 0.02 to about 1.0 part by weight of at least one of dibenzylidene sorbitol, ditoluylidene sorbitol, tribenzylidene sorbitol, tritoluylidene sorbiol and hydrogenated castor oil.

The invention further provides a fuel composition comprising 100 parts by weight of a coal-liquid fuel mixture, about 0.02 to about 1.0 part by weight of at least one of dibenzylidene sorbitol, ditoluylidene sorbitol, tribenzylidene sorbitol, tritoluylidene sorbitol and hydrogenated castor oil, and about 1 to about 10 parts by weight of water.

We have conducted extensive research in an attempt to obtain COM's having improved stability during storage and transport and found that a COM composition which has a minimized tendency to separate into layers and which is feedable through a line with extreme ease can be prepared by admixing at least one of specific sorbitol derivatives and hydrogenated castor oil with a COM. We have also found that the COM composition exhibits improved viscosity characteristics when further incorporating a specified amount of water. This invention has been accomplished based on these novel findings.

The COM composition of this invention comprises coal and a liquid fuel usually in the ratio of about 20 to about 60 parts by weight of the former to about 80 to about 40 parts by weight of the latter. The coal is used in the form of fine particles usually minus 100 mesh, preferably 150 to 250 mesh, in size. The liquid fuel is not particularly limited but may be any of those derived from petroleum, coal and other materials. In view of ease of availability, A fuel oil, B fuel and C fuel oil according to JIS (Japanese Industrial Standards) K2205 and like fuel oils are suitable, among which C fuel oil is especially advantageous to use.

With this invention, the aforementioned specific sorbitol derivatives and hydrogenated castor oil are used usually in an amount of about 0.02 to about 1.0 part by weight, preferably about 0.04 to about 0.5 part by weight, per 100 parts by weight of the COM. It is generally preferable to use an increasing amount of the additive with an increase in the proportion of the coal in the COM. With less than 0.02 part by weight of the additive present, the COM composition is likely to separate into layers, whereas with more than 1.0 part by weight of the additive present, the COM composition tends to have reduced flowability.

When water is used conjointly with at least one of the specific sorbitol derivatives and hydrogenated castor oil, the combined amount of the water used and the water contained in the coal is usually about 1 to about 10 parts by weight, preferably about 2 to about 4 parts by weight, per 100 parts by weight of the COM. With less than 1 part by weight of water present, the composition will not have sufficiently improved viscosity characteristics, whereas amounts exceeding 10 parts by weight will give the composition a greatly reduced calorific value.

The COM composition of this invention can be prepared by various methods, for example, by dissolving a predetermined amount of at least one of the specific sorbitol derivatives and hydrogenated castor oil in a liquid fuel maintained at 120° to 160° C. and uniformly dispersing a predetermined amount of finely divided coal in the solution as maintained at the same temperature or cooled to room temperature. When water is used, the composition is prepared, for example, by dissolving a specified sorbitol derivative or hydrogenated castor oil in a liquid fuel at about 120° to 160° C., uniformly admixing finely divided coal with the solution and further admixing water with the resulting mixture. Alternatively finely divided coal containing a predetermined quantity of water may be added to a mixture of liquid fuel and sorbitol derivative or hydrogenated castor oil maintained at about 100° to about 140° C. and uniformly mixing the ingredients. These methods of preparing the composition are not limitative; the ingredients can be added in various different orders.

The composition of this invention comprising a COM and at least one of specific sorbitol derivatives and hydrogenated castor oil usually has a static apparent viscosity ($V'_6$, 70° C.) of about 20 to about 100 poises, a viscosity under shearing stress ($V'_{60}$, 70° C.) of about 6 to about 40 poises and a thixotropic index ($V'_6/V'_{60}$) of about 2 to about 4 and exhibits satisfactory flowability under gravity, although these properties vary with the ratio between the coal and the liquid fuel, particles size of the coal, kind of the liquid fuel, amount(s) of the sorbitol derivative and/or hydrogenated castor oil. Ditoluylidene sorbitol and dibenzylidene sorbitol, when used, act very effectively to prevent the coal from settling in the composition but may give an increased viscosity or reduced flowability to the composition during storage. Thus the increase in the apparent viscosity of the composition will render the composition thixotropic. In such an event, the composition may be subjected to pressure or agitated to cause the composition to restore the desired flowability.

The composition of this invention comprising a COM and at least one of the specific sorbitol derivatives and hydrogenated castor oil, when further incorporating water, usually has a static viscosity ($V'_6$, 70° C.) of about 15 to about 100 poises and a viscosity under shearing stress ($V'_{60}$, 70° C.) of about 5 to about 50 poises and a thixotropic index of about 2 to about 5 and exhibits good flowability.

The COM composition of this invention retains high stability over a prolonged period of time, such that even when stored, for example at about 50° to 70° C. for 1 month, the composition substantially will not separate into layers but remains as stable as immediately after preparation and exhibits good flowability. Since none of the additives to be used in this invention contain heavy metals or hetero-atoms other than carbon, oxygen and hydrogen, the composition, when burned, will not give ash or corrosive gas due to the presence of the additive. Thus the combustion furnace for the composition need not be provided with any protective means.

The features of the invention will become more apparent from the following examples, in which dibenzylidene sorbitol will be referred to briefly as "A", ditoluylidene sorbitol as "B⇄ tritoluylidene sorbitol as "C," tribenzylidene sorbitol as "D," and hydrogenated castor oil as "E." In the examples, the parts and percentages are all by weight.

EXAMPLES 1 to 5

A 75 g quantity of C fuel oil is placed into a tall beaker, and additive A is dissolved in the oil at a specified temperature. A 25 g quantity of finely divided coal, minus 200 mesh in particle size, is added to the solution and dispersed at a high speed for 30 minutes with use of a blender while cooling the mixture to room temperature. The same procedure as above is repeated with use of additives B to E.

Table 1 shows the conditions used for the preparation of the compositions in Examples 1 to 5 along with the properties of the compositions. Table 1 also shows the properties of a reference mixture composed only of 75 g of C fuel oil and 25 g of finely divided coal.

TABLE 1

| Example No. | (Ref. mix.) | 1 | 2 | 3 | 4 | 5 |
|---|---|---|---|---|---|---|
| Additive | — | A | B | C | D | E |
| Amount of additive (part) | — | 0.1 | 0.1 | 0.1 | 0.1 | 0.1 |
| Dissolving temperature (°C.) | — | 130 | 130 | 130 | 160 | 120 |
| $V_6$ (poises)* | 10 | 11 | 12 | 30 | 31 | 10 |
| Stability** | | | | | | |
| In 7 days | | | | | | |
| Upper layer (%) | 18 | 25 | 25 | 25 | 25 | 19 |
| Lower layer (%) | 39 | 26 | 25 | 25 | 25 | 39 |
| Caking | None | None | None | None | None | None |
| Flowability | Good | Good | Good | Slightly low | Slightly low | Good |
| In 30 days | | | | | | |
| Upper layer (%) | 2 | 23 | 23 | 24 | 25 | 3 |
| Lower layer (%) | 60 | 28 | 29 | 26 | 25 | 60 |
| Caking | Occurred | None | None | None | None | Slight |
| Flowability | None | Good | Good | Slightly low | Slightly low | Slightly low |

Note:
*Measured by a B-type viscometer at 6 r.p.m.
**The composition is allowed to stand for 7 or 30 days in a container and then divided into an upper half portion and a lower half portion as an upper layer and a lower layer. The fuel oil in each of the layers is extracted with carbon tetrachloride, and the coal residue is dried and weighed to calculate the coal content (%) of the layer.

EXAMPLES 6 to 10

COM compositions are prepared under the conditions listed in Table 2 with use of an additive, 50 g of C fuel oil and 50 g of minus 200 mesh finely divided coal for each composition. Table 2 also shows the properties of a reference mixture composed only of 50 g of C fuel oil and 50 g of finely divided coal.

TABLE 2

| Example No. | (Ref. mix.) | 6 | 7 | 8 | 9 | 10 |
|---|---|---|---|---|---|---|
| Additive | — | A | B | C | D | E |
| Amount of additive (part) | — | 0.2 | 0.4 | 0.3 | 0.3 | 0.5 |
| Dissolving temperature (°C.) | — | 130 | 130 | 160 | 160 | 120 |
| $V_6$ (poises)* | 30 | 41 | 50 | 98 | 103 | 39 |
| Stability** | | | | | | |
| In 7 days | | | | | | |
| Upper layer (%) | 33 | 48 | 50 | 49 | 50 | 46 |
| Lower layer (%) | 69 | 51 | 50 | 50 | 50 | 58 |
| Caking | None | None | None | None | None | None |
| Flowability | Low | Good | Slightly low | Slightly low | Slightly low | Good |
| In 30 days | | | | | | |
| Upper layer (%) | 2 | 45 | 50 | 50 | 50 | 40 |
| Lower layer (%) | 80 | 55 | 50 | 50 | 51 | 67 |
| Caking | Occurred | None | None | None | None | None |
| Flowability | None | Good | Slightly low | None* | None* | Good |

Note:
*The composition easily restores its flowability when subjected to pressure or agitated.

EXAMPLE 11

One gram (0.05 part) of dibenzylidene sorbitol is added to and dissolved in 940 g (48 parts) of C fuel oil maintained at 140° C. Subsequently 1000 g (52 parts) of finely divided coal, minus 200 mesh in particle size, is uniformly dispersed in the solution, and 60 g (3 parts) of water is thereafter added to the mixture at 90° C. to obtain a COM composition.

The COM composition is poured and allowed to stand in a measuring cylinder storage can (5.3 cm in diameter, 21 cm in height and 500 ml in capacity) placed in a thermostat at 60° C. Thirty days thereafter, the composition is tested for the degree of separation into layers, viscosity, thixotropy, glass bar penetration velocity and flowability. Table 4 shows the results.

EXAMPLES 12 to 20

COM compositions are prepared according to the invention in the same manner as in Example 11 except that the specific sorbitol derivatives or hydrogenated castor oil and water are used in the proportions listed in Table 3. Table 4 shows the properties of the compositions.

COMPARISON EXAMPLE 1

A COM is prepared only from 1000 g of finely divided coal, minus 200 mesh in particle size, and 940 g of fuel oil. Table 4 shows the properties of the mixture.

COMPARISON EXAMPLE 2

A COM is prepared in the same manner as in Example 12 except that dibenzylidene sorbitol is not used but 4 parts of water is used. Table 4 shows the properties of the mixture.

COMPARISON EXAMPLE 3

A COM composition is prepared in the same manner as in Example 11 except that no water is used. Table 4 shows the properties of the composition.

COMPARISON EXAMPLE 4

A COM composition is prepared in the same manner as in Example 13 except that 1.5 parts of dibenzylidene sorbitol is used. Table 4 shows the properties of the composition.

COMPARISON EXAMPLE 5

A COM composition is prepared in the same manner as in Example 12 except that 0.01 part of dibenzylidene sorbitol is used. Table 4 shows the properties of the composition.

TABLE 3

| | | Additive (parts) | | | | | |
|---|---|---|---|---|---|---|---|
| | | A | B | C | D | E | Water |
| Ex. | 11 | 0.05 | 0 | 0 | 0 | 0 | 3 |
| " | 12 | 0.05 | 0 | 0 | 0 | 0 | 4 |
| " | 13 | 0.05 | 0 | 0 | 0 | 0 | 4 |
| " | 14 | 0 | 0.1 | 0 | 0 | 0 | 7 |
| " | 15 | 0.3 | 0 | 0 | 0 | 0 | 2 |
| " | 16 | 0 | 0.08 | 0 | 0 | 0 | 5 |
| " | 17 | 0.06 | 0 | 0 | 0 | 0 | 3 |
| " | 18 | 0 | 0 | 1 | 0 | 0 | 5 |
| " | 19 | 0 | 0 | 0 | 0.8 | 0 | 4 |
| " | 20 | 0 | 0 | 0 | 0 | 1 | 10 |
| Comp. Ex. | 1 | 0 | 0 | 0 | 0 | 0 | 0 |
| Comp. Ex. | 2 | 0 | 0 | 0 | 0 | 0 | 4 |
| Comp. Ex. | 3 | 0.05 | 0 | 0 | 0 | 0 | 0 |
| Comp. Ex. | 4 | 1.5 | 0 | 0 | 0 | 0 | 4 |
| Comp. Ex. | 5 | 0.01 | 0 | 0 | 0 | 0 | 4 |

TABLE 4

| | Storage temperature (°C.) | Properties in 30 days: Coal concn. of layers (%) Upper | Middle | Lower | Viscosity at 70° C. (poises) $V'_6$ | $V'_{60}$ | $\frac{V'_6}{V'_{60}}$ | Flowability | Penetration* time (sec) As prepared | In 30 days |
|---|---|---|---|---|---|---|---|---|---|---|
| Ex. 11 | 60 | 45 | 53 | 53 | 37 | 12 | 3.1 | Good | 11 | 21 |
| Ex. 12 | 60 | 45 | 53 | 54 | 38 | 12 | 3.2 | " | 12 | 20 |
| Ex. 13 | 50 | 50 | 50 | 50 | 38 | 12 | 3.2 | " | 12 | 16 |
| Ex. 14 | 60 | 41 | 54 | 54 | 38 | 12 | 3.2 | " | 7 | 23 |
| Ex. 15 | 70 | 50 | 50 | 50 | 78 | 18 | 4.3 | " | 10 | 15 |
| Ex. 16 | 60 | 47 | 51 | 51 | 67 | 19 | 3.5 | " | 10 | 30 |
| Ex. 17 | 60 | 46 | 52 | 52 | 41 | 12 | 3.4 | " | 7 | 20 |
| Ex. 18 | 50 | 38 | 55 | 56 | 28 | 14 | 2.0 | Slightly poor | 8 | 50 |
| Ex. 19 | 50 | 40 | 55 | 57 | 32 | 15 | 2.1 | Slightly poor | 9 | 45 |
| Ex. 20 | 50 | 35 | 56 | 55 | 30 | 15 | 2.0 | Slightly poor | 7 | 50 |
| Comp. Ex. 1 | 60 | 8 | 65 | 67 | — | — | — | None | 0.4 | ∞ |
| Comp. Ex. 2 | 70 | 8 | 64 | 65 | — | — | — | " | 0.4 | ∞ |
| Comp. Ex. 3 | 60 | 30 | 59 | 60 | 14 | 6 | 2.3 | Slightly poor | 4 | 42 |
| Comp. Ex. 4 | 60 | 50 | 50 | 50 | 150 | 40 | 3.8 | None | 80 | 100 |
| Comp. Ex. 5 | 60 | 15 | 63 | 64 | — | — | — | " | 0.4 | ∞ |

Note:
*The time required for a glass bar, 5 mm in diameter and weighing 20 g, to penetrate vertically through the composition under gravity.

We claim:

1. A fuel composition comprising 100 parts by weight of a coal-liquid fuel mixture and 0.02 to 1.0 part by weight of at least one additive selected from the group consisting of dibenzylidene sorbitol, ditoluylidene sorbitol, tribenzylidene sorbitol, tritoluylidene sorbitol and hydrogenated castor oil.

2. A fuel composition according to claim 1 wherein the coal-liquid fuel mixture comprises about 20 to about 60 parts by weight of coal and about 80 to about 40 parts by weight of liquid fuel.

3. A fuel composition according to claim 1 wherein the amount of the additive is about 0.04 to about 0.5 part by weight per 100 parts by weight of the coal-liquid fuel mixture.

4. A fuel composition comprising 100 parts by weight of a coal-liquid fuel mixture, 0.02 to 1.0 part by weight of at least one additive selected from the group consisting of dibenzylidene sorbitol, ditoluylidene sorbitol, tribenzylidene sorbitol, tritoluylidene sorbitol and hydrogenated castor oil, and 1 to 10 parts by weight of water.

5. A fuel composition according to claim 4 wherein the coal-liquid fuel mixture comprises about 20 to about 60 part by weight of coal and about 80 to about 40 parts by weight of liquid fuel.

6. A fuel composition according to claim 4 wherein the amount of the additive is about 0.04 to about 0.5 part by weight per 100 parts by weight of the coal-liquid fuel mixture.

7. A fuel composition according to claim 4 wherein the amount of water is about 2 to about 4 parts by weight per 100 parts by weight of the coal-liquid fuel mixture.

* * * * *